United States Patent [19]

Michaud

[11] Patent Number: 4,577,820

[45] Date of Patent: Mar. 25, 1986

[54] PAINT PAIL HOLDER AND WOODEN LADDER ADAPTOR FOR SAME

[75] Inventor: Jeffrey J. Michaud, Bellows Falls, Vt.

[73] Assignee: J. D. Tools, Inc., Bellows Falls, Vt.

[21] Appl. No.: 630,602

[22] Filed: Jul. 13, 1984

[51] Int. Cl.[4] ..... E06C 7/14

[52] U.S. Cl. ..... 248/211; 248/312.1

[58] Field of Search ..... 248/210, 211, 312.1, 248/311.2, 231.9; 182/129

[56] References Cited

U.S. PATENT DOCUMENTS

| | | | |
|---|---|---|---|
| 927,367 | 7/1909 | Marshall | 248/216.1 |
| 2,226,228 | 12/1940 | Kunde . | |
| 2,367,256 | 1/1945 | Atkins . | |
| 2,541,390 | 2/1951 | Weigand | 248/312.1 X |
| 2,542,737 | 2/1951 | Vogel | 248/211 X |
| 2,598,479 | 5/1952 | Wraith . | |
| 2,645,443 | 7/1953 | Pelletier | 248/211 |
| 2,993,672 | 7/1961 | Bower et al. . | |
| 3,160,383 | 12/1964 | Lamm | 248/211 |
| 3,223,369 | 12/1965 | Benninger, Jr. . | |
| 3,458,165 | 7/1969 | Crow | 248/210 |
| 3,603,548 | 9/1971 | Meyer | 248/312.1 X |
| 3,979,097 | 9/1976 | Balne | 182/129 X |
| 4,099,693 | 7/1978 | Blann . | |
| 4,120,472 | 10/1978 | Balne | 248/211 |
| 4,523,733 | 6/1985 | Lunden | 248/210 |

*Primary Examiner*—J. Franklin Foss

*Attorney, Agent, or Firm*—Sughrue, Mion, Zinn Macpeak & Seas

[57] ABSTRACT

An elongated sheet metal bar of inverted V-shape cross-section is bifurcated at one end forming outwardly flared wings with an integral downwardly facing hook between the wings which hook is engageable with the rim of a paint pail while the wings contact the circumference of the pail below the rim to securely grasp the paint pail and hold it in upright position. The other end of the bar is inserted into a hollow rung of a hollow rung ladder with the weight of the pail causing the bar to frictionally grip the hollow rung. Serrations on the bottom of the inverted V-shape sheet metal bar adjacent the bifurcation assists in frictionally gripping the rung to secure the paint pail. A vertically mounted adjusting screw to the opposite end of the bar interiorly of the rung also facilitates locking of the bar to the ladder rung. A separate U-shaped sheet metal member functions as a wooden ladder adaptor by enveloping about a ladder side rail and hooking itself over a solid rung. Reverse L-shaped slots within the sides of the separate U-shaped adaptor define upper hook shaped arms looped over the ladder rung while aligned holes in lower arms to the rear of the side rails function to receive the elongated sheet metal bar whose opposite end grasps the paint pail.

9 Claims, 10 Drawing Figures

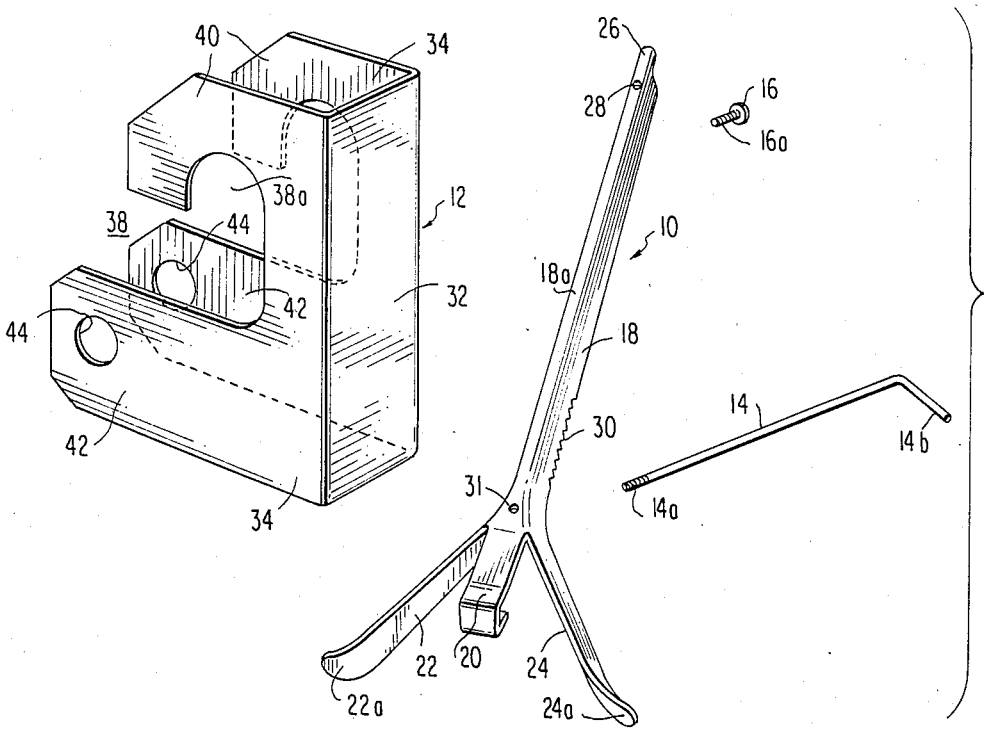
FIG. 1
FIG. 2
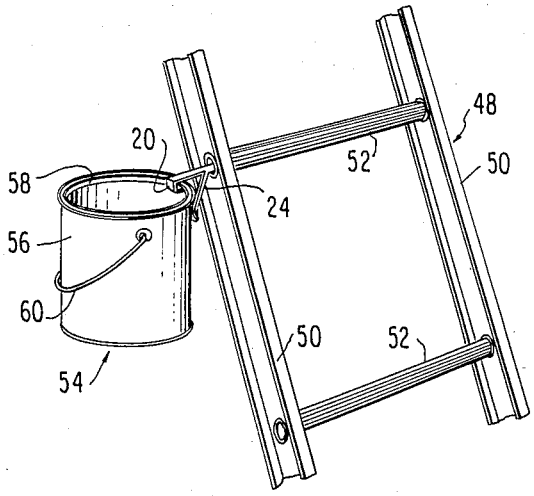
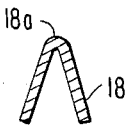
FIG. 4
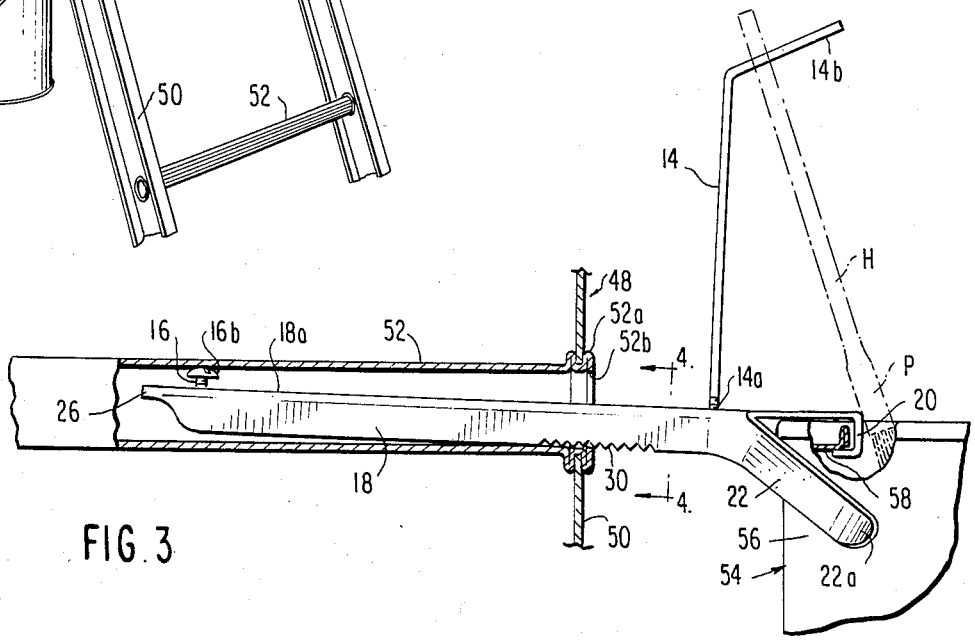
FIG. 3

FIG. 5
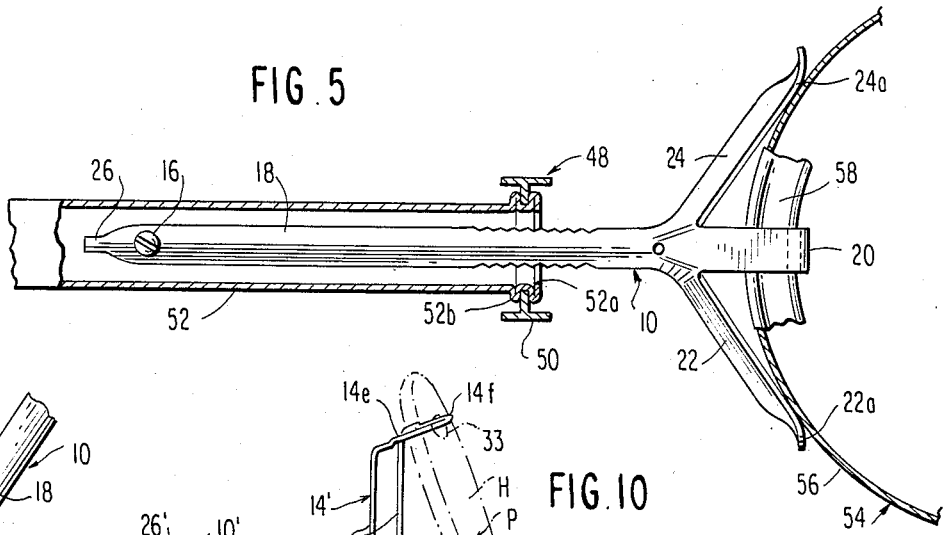
FIG. 6
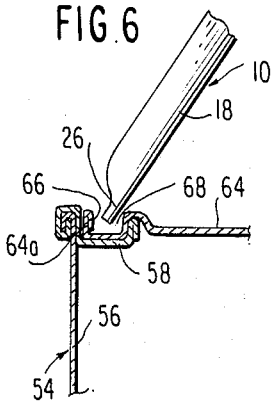
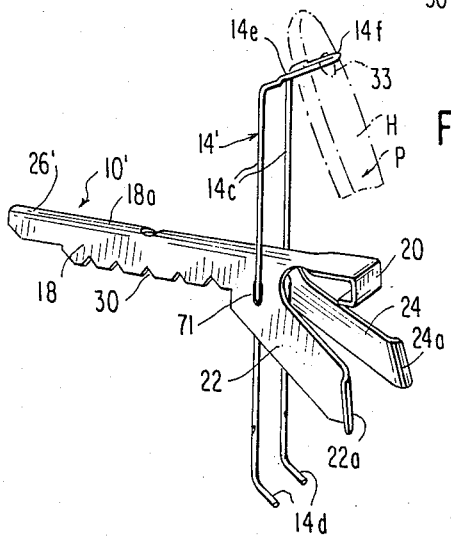
FIG. 10
FIG. 7
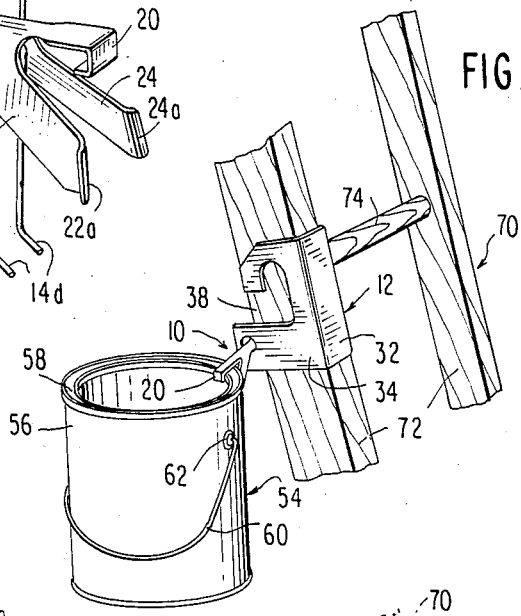
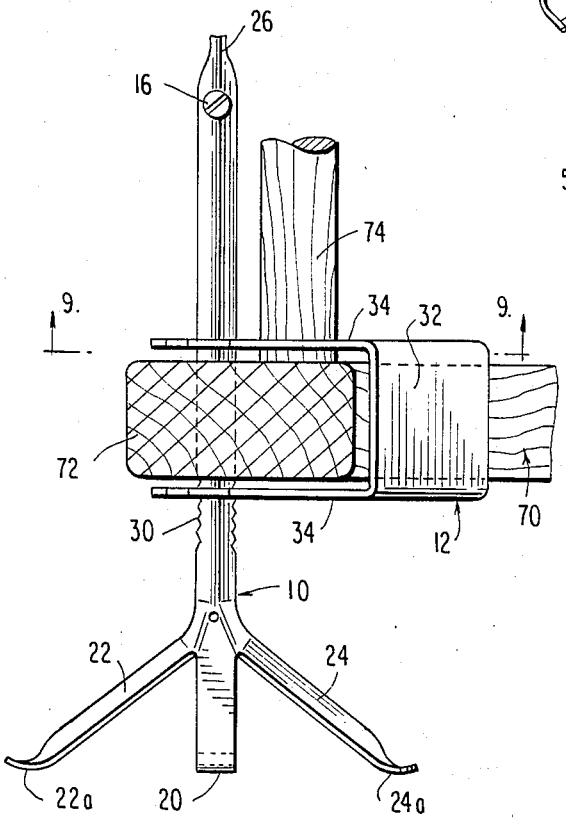
FIG. 8
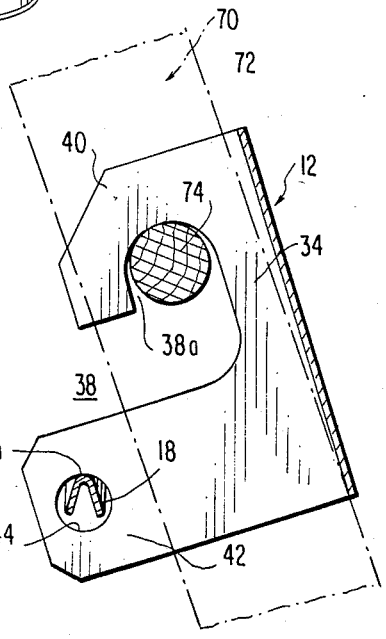
FIG. 9

PAINT PAIL HOLDER AND WOODEN LADDER ADAPTOR FOR SAME

FIELD OF THE INVENTION

This invention relates to paint pail holders, and more particularly, to an improved unitary sheet metal holder for supporting a paint pail to the side of a hollow rung type ladder and further to a specially formed sheet metal wooden ladder adaptor for permitting the paint pail holder to adapt to wooden ladders having solid rungs.

BACKGROUND OF THE INVENTION

Unitary paint can or paint pail holder supports have been formulated for specific use in conjunction with hollow rung type ladders. One such support is exemplified by U.S. Pat. No. 4,099,693 to Ellis L. Blann, issued July 11, 1978. The unitary device is formed of wire or cylindrical steel bar stock, is of a length in excess of the length of a hollow rung through which it passes. It is provided with an upturned portion at one end where that end protrudes from the end of the rung, while the opposite end, protruding from the opposite end of the rung, terminates in a downwardly directed portion to which is welded a V-shaped flange for engaging the sides of the bucket or pail. In turn, an upwardly projecting stud at the same end engages the wire handle of the paint pail or bucket, and the weight of the pail and its contents causes the upwardly turned portion at the other end of the wire rod to engage the edge of the hollow rung, remote from the pail, to prevent the rod from moving out of the hollow rung, while the lower edge of the same rod contacts the periphery of the hollow rung at its opposite end. Thus, the wire rod is angled slightly downwardly in a manner to secure the holder to the hollow rung ladder but permit its removal when the painter is required to move up or down the ladder to paint the other portions of the surface of the wall being coated.

As such, the paint pail is positioned to the side of the ladder where it is readily accessible, rather than behind it as is the case when the pail is supported by an S-shaped hook from the exterior of the ladder rung. Due to weight distribution, the support and the paint pail itself is levelled and the arrangement permits the bail to be positioned away from the top of the container to the side towards the ladder, thus freeing the whole rim surface for permitting the removal of excess paint from the paint brush or similar applicator.

While such container support operates satisfactorily to some degree, it has certain limitations. It is applicable only to paint pails which have integral handles, is limited in some respects to certain size paint pails due to the relationship of the handle location on the pail itself, the length of the same, and the position of the upright stud which acts as a stop to prevent the container from slipping off the support. Further, since the support is held in position primarily and almost solely by the upright end on the rod remote from the pail, under certain conditions the rod may be dislodged from the hollow rung, particularly since the rod is of a relatively small diameter compared to the interior diameter of the hollow rung itself. Additionally, while the support is adequate to permit mounting of the support rod to the hollow rung ladder, the support is incapable of use in mounting or supporting a paint pail to a conventional wooden ladder which employs solid wooden rungs.

It is, therefore, a primary object of the present invention to provide an improved, inexpensive paint pail holder which is sized closely to the hollow rung ladder to which it is mounted, wherein the mount is adaptable to paint pails which are free of handles, wherein the frictional grip between the holder and the hollow rung within which it is mounted is substantially improved, wherein the holder is of simplified construction and may be readily formulated as a unitary structure from sheet metal stock, and wherein it may be mounted to a specially formulated sheet metal wooden ladder adaptor, maximizing its use.

Other objects and advantages of the present invention will become apparent from a study of the following description and accompanying drawings which are illustrative of a preferred embodiment of the present invention, both in terms of the paint pail holder particularly useful in mounting a paint pail to the side of a hollow rung ladder and to a wooden ladder adaptor for permitting the holder to be employed in mounting a paint pail in similar fashion to the side of a wooden ladder having solid rungs.

BRIEF DESCRIPTION OF THE DRAWINGS

FIG. 1 is an exploded perspective view of the paint pail holder and wooden ladder adaptor employed therewith, forming a preferred embodiment of the present invention.

FIG. 2 is a perspective view of a hollow rung ladder to which the paint pail holder of FIG. 1 is mounted and functioning to support an openly upright paint pail.

FIG. 3 is a vertical sectional view of the paint pail holder mounted to the hollow rung ladder of FIG. 2.

FIG. 4 is a transverse sectional view of the paint pail holder of FIG. 3, taken about line 4—4.

FIG. 5 is a top plan view of the paint pail holder of FIG. 3 with the ladder rung partially broken away in the area of penetration by the paint pail holder.

FIG. 6 is a vertical sectional view of a portion of a paint pail with cover in place and showing howe one end of the paint pail holder functions as a tool to assist in removing the lid from the paint pail prior to mounting to the side of a ladder.

FIG. 7 is a perspective view of the paint pail holder mounting an open paint pail via the channel-shaped wooden ladder adaptor of FIG. 1 to a wooden ladder.

FIG. 8 is a top plan view of the assembly of FIG. 7.

FIG. 9 is a vertical sectional view of the assembly of FIG. 8, taken about line 9—9.

FIG. 10 is a perspective view of the paint pail holder forming yet another embodiment of the invention.

DESCRIPTION OF THE PREFERRED EMBODIMENT

Referring to the drawings and initially FIG. 1, there are shown in perspective view, two major components of the present invention constituting a paint pail holder indicated generally at 10 and a wooden ladder adaptor 12 for that holder. Holder 10, per se, is usable absent the adaptor 12 in conjunction with a conventional hollow rung metal ladder, as best seen in FIG. 2.

The paint pail holder 10 includes as components thereof, an elongated, inverted V-shaped pail mounting or support bar 18, threaded metal adjusting screw 16 and a generally L-shaped wire rod paint brush holder 14, both these components being threadably mounted to the elongated inverted V-shaped pail mounting or support bar 18. The bar 18 is formed of sheet metal stock and is bent into inverted V-shaped configuration, as best seen in FIG. 4, over the major portio of its length. At one end, bar 18 is bifurcated to form laterally opposed downwardly bent wings as at 22, 24, while a unitary hook 20 is integrated to the elongated bar 18 at its center, extending between the wing 24. Hook 20 faces downwardly, while wings 22 in addition to being flared outwardly from the general longitudinal axis of bar 18 extend diagonally downwardly below the hook 20. Hook 20 take the form of a rectangular strip which is reversely bent at its end towards the main body of the bar 18. The tips of the wings are bent or curved so as to flare further outwardly, thus forming contact surface areas 22*a*, 24*a*, respectively, for contacting the side of a paint pail, indicated generally at 54 in FIG. 2.

The inverted V-shaped bar 18 terminates at its end remote from hook 20 and wings 22, 24 in a reduced thickness portion 26 which forms a screwdriver-like edge or lid opening tool, FIG. 6, for removing the cover 64 from the paint pail 54. Also, at that end of bar 18, on the top or apex 18*a* thereof, is a first tapped hole 28 which receives the threaded end 16*a* of adjusting screw 16. Adjacent to the hook 20 and at the point of bifurcation of the inverted V-shaped mounting bar 18 is a second tapped hole as at 31 which receives the threaded end 14*a* of the inverted L-shaped paint brush holder 14 whose opposite end 14*b* is bent at some angle approximating 75 degrees, as perhaps best seen in FIG. 3. The paint brush P has a hole 33 in its handle H, so that the paint brush may be hung on portion 14*b* of holder 14, FIG. 3. The lower edges of the inverted L-shaped mounting bar 18 are provided with serrations as at 30 over an extent of the bar just behind the bifurcation forming wings 22, 24, whose function may be best seen in FIG. 3 as functionally engaging the inner edge or periphery 52*a* of the hollow ladder rung 52.

Turning next to the wooden ladder adaptor 12, this element is also formed of sheet metal stock, is of channel form, and comprised of a base 32 and opposed, right angle, projecting sides 34. A reverse L-shaped slot 38 is formed within both sides, creating separate upper arms 40 and lower arms 42 for both sides. The lower arms 42 extend further from base 32 than do the upper arms 40. Further, a pair of aligned circular holes 44 are formed within the lower arms 42 sized to permit the insertion of the mounting bar 18 where as seen in FIGS. 7–9 inclusive, the paint pail is mounted to the side of a wooden solid rung ladder 70, rather than the aluminum type hollow rung ladder 48 as illustrated in FIGS. 2 and 3.

Referring to FIGS. 2–5, it is seen that the paint pail holder 10 has particular application to the mounting of an open paint pail, indicated generally at 54, to one side of a aluminum type hollow rung ladder 48 comprised of laterally spaced side rails 50 joined by a plurality of spaced hollow rungs 52. As seen in FIG. 3, the hollow rungs terminate at their ends in radially enlarged flange portions as at 52*b* having circular inner peripheral edges 52*a*, one of which is engaged by the serrations 30 on the bottom of the inverted V-shaped mounting bar 18, when the tool end of the paint pail holder mounting bar 18 is inserted into either open end of a given rung 52. The bar 18, which may be 8 to 10 inches long, bears, as stated previously, an adjusting screw 16 which is threaded into the tapped hole 28 so its head projects above the apex 18*a* of the inverted L-shaped mounting bar 18. Its height is adjusted to the internal diameter of the ladder rungs 52. As such, the adjusting screw 16 is adjusted so that the height of the bar 18 plus that of the adjusting screw 16, at that end, is somewhat less than the internal diameter of the hollow ladder rung 52. This permits the insertion of that end of the bar 18 within the hollow rung 52 in the manner shown in FIG. 3.

As may be appreciated, the paint bucket or pail 54 is of cylindrical form with the cylindrical sidewall 56 terminating in a flanged rim 58 whose opening is normally closed off by lid 64, FIG. 6. The lid 64 is removed, in the manner of FIG. 6, by using the screwdriver-like tip 26 of hanger 10, which tip 26 is inserted within annular groove 68 formed within the flanged periphery or lip 64*a* of the lid 64. The tip 26 engages a reversely bent terminal end portion 66 of the lip 64*a*, thus unseating the lid lip from a groove of rim 58 of the paint containing pail 54 and receiving lid lip 64*a*. With the lid 64 removed, the hook 20 integral with mounting bar 18 is hooked over the rim 58 as best seen in FIG. 3. When the bar 18 is positioned so that it extends generally perpendicular to the axis of the pail 54, the bifurcated wings 22, 24 contact the perphery of the cylindrical sidewall 56 of the pail 54 at the flared ends 22*a*, 24*a*, respectively. In this manner, the other end of the holder 10 is inserted into a hollow rung 52 of ladder 48. The weight of the pail 54 and the contents causes the mounting bar 18 to incline slightly from the horizontal with the serrations 30 gripping edge 52*a* of the hollow rung 52 and driving the adjustment screw 16 upwardly so that the slotted head 16*b* of the adjustment screw 16 abuts the interior of the hollow rung 52, at the top thereof. The pail is securely, frictionally maintained in the position shown in FIG. 3 with the contents of the pail readily available to the painter. In FIG. 3, the paint brush holder 14 is in a position such that the handle H of the paint brush, shown in dotted lines at P, FIG. 3, impinges on the inclined portion 14*b* of the wire rod paint brush holder 14, via hole 33 of the brush handle H through which bent end 14*b* of the holder 14 projects.

Turning next to FIGS. 7–9 inclusive, it may be seen that the present invention has additional application to utilizing the same type of paint pail holder 10 in its identical form in holding the paint pail 54 in vertical upwardly open fashion to the side of a wooden ladder 70. The wooden ladder 70 is functionally similar to that of the aluminum type hollow rung ladder 48 shown in FIG. 2 and is comprised of laterally opposed wooden side rails 72 which may take the form of 2×4's or the like and across which spans a series of solid wooden rungs 74, at longitudinally spaced positions. In this situation, the wooden ladder adaptor 12 is mounted initially to the ladder such that its base 32 contacts the front edge of a given side rail 72 and wherein the sides 34 of the channel shaped wooden ladder adaptor 12 extend along opposite sides of the rail 72. The reverse L-shaped slot 38 includes a semi-circular vertical slot portion 38*a* which is configured and sized, FIG. 9, so as to receive the cylindrical solid wooden rung 74 with the rung 74 nested therein, FIG. 9, and functioning to prevent the adaptor from sliding down the rail 72.

As may be seen in FIGS. 7, 8 and 9, the lower arms 42 project well beyond the rear edge of the ladder rail 72, permitting the mounting bar 18 to project through the aligned circular holes 44 which are appropriately sized so as to permit the free insertion but having a diameter only slightly larger than the maximum transverse dimension of the mounting bar 18. Appropriately, the mounting bar 18 is inserted to a position such that the serrations 30 engage the edge of the hole 44 within the lower arm 42 of the wooden ladder adaptor 12 adjacent the outside face of rail 72, while the mounting bar 18 tilts so that the apex 18*a* of the mounting bar 18 contacts the upper edge of the circular hole 44 of lower arm 42, to the inside of rail 72, FIG. 9. Good frictional contact is maintained due to the weight of the paint pail 54 and its contents acting on the paint pail holder 10 in very similar manner to the frictional gripping action occurring during mounting of the pail 54 to the aluminum type hollow rung ladder 48, FIG. 2. In both cases, a handle 60, if carried, and mounted to the pail 54 by way of grommet 62 rests against the cylindrical sidewall 56 of the pail out of the way of the painter and in a position so as not to interfere with the painter in dipping the paint brush P into the interior of the open pail with ready access to the interior thereof. While the components have been described of being made of bent or otherwise formed sheet metal, it may be appreciated that the wooden ladder adaptor 12 and the paint pail holder 10 may be formed of molded plastic or the like.

Referring next to FIG. 10, there is illustrated another embodiment of the paint pail holder of the present invention, wherein like elements have like numerical designations. The paint pail holder 10' has an elongated, inverted V-shaped pail mounting or support bar 18 which is essentially like that of the first embodiment, although of shorter length and actually looks stubbier. The bar 18 again is formed of sheet metal stock and is bent into inverted V-shaped configuration over a major portion of its length, the one end is bifurcated to form laterally opposed downwardly bent wings as at 22, 24, while unitary hook 20 extends between the wings and is bent downwardly from the plane of the apex 18*a* of the support bar proper. Again, the tips of the wings are curved and flare outwardly to form the contact surface areas 22*a*, 24*a*, as in the embodiment of FIG. 1. Again, the lower edges of the inverted V-shaped mounting bar are provided with serrations as at 30 over an extent of the bar just behind the bifurcation forming wings 22, 24. The same function is provided for serrated edges 30 to frictionally engage the inner edge or periphery 52*a* of the hollow ladder rung 52 when employed in the manner of FIG. 3. Unlike FIG. 3, however, the embodiment of FIG. 10 is provided with a vertically adjustable paint brush holder 14' which, while being formed of rod or wire material as in the embodiment of FIGS. 1 and 3, is adjustably mounted on the paint pail holder 10' and may be raised and lowered depending upon the size of the paint pail to which the holder 10' is attached.

The paint brush holder 14' is formed of wire or rod stock and includes a pair of vertical legs as at 14*c* which are curved at their ends 14*d* and which legs 14*c* ride within vertical slots 71 within wings 22 and 24 at their upper ends. Additionally, the wire rod legs 14*c* are integral and formed from a single piece of wire which is bent at its middle 14*e* to give the paired legs 14*c* and the configuration desired. Over portions 14*f* from the bend point 14*e* for some extent, the bent wires contact each other to define an upwardly and outwardly projecting support which passes readily through hole 33 of the paint brush P and specifically within handle H of that paint brush.

The only other difference between this embodiment and the embodiment of FIGS. 1 and 3 is the fact that the support bar 18 does not carry near or adjacent its end remote from hook 20 a threaded screw, the bar is considerably shorter than its counterpart in FIG. 1, and the tip end 26' opposite the end bearing the hook 20 rests on the inside of the hollow ladder rung if employed in that environment and contacts the interior of the hollow rung some several inches away from the point of contact between serrations 30 and the perpheral edge of the hollow rung where it mounts to the side rail. By grasping legs 14*c* of the paint brush holder, the paint brush holder can be lowered and raised relative to the paint pail holder 10'. This provides the adjustability missing from the embodiment of FIGS. 1 and 3 where fixed height of the bent portion 14*b* of the paint brush holder 14 and, of course, the position of hole 33 within the paint brush handle H defines the location of the paint brush as it is suspended on that holder.

While the invention has been particularly shown and described with reference to a prefered embodiment thereof, it will be understood by those skilled in the art that various changes in form and details may be made therein without departing from the spirit and scope of the invention.

What is claimed is:

1. A paint pail holder for supporting an open paint pail having an internally flanged rim to the side of an aluminum type ladder having hollow rungs opening through side rails of the ladder at both ends thereof; said holder comprising: an elongated sheet metal bar of inverted V-shaped cross-section sized to slide freely at one end into a given hollow run of said ladder, the opposite end of said bar being bifurcated to form outwardly flared wings, and a downwardly facing, integral hook projecting between the bifurcated wings at said other end, said hook being engageable with the rim of the paint pail with said wings contacting the outside of said pail below said rim to securely grasp the pail and hold it in upright, open position; and wherein the edges of said inverted V-shaped cross-section sheet metal bar at the end adjacent the bifurcation engages the edges of the open end of said rung within which said bar is inserted; and wherein the apex of the inverted V-shaped cross-section sheet metal bar remote from said bifurcation projects upwardly towards the top of said hollow rung to effect frictional contact at the end to the top of said hollow rung interior, such that the weight of the paint pail and its contents causes effective frictional locking between said elongated sheet metal mounting bar and said hollow rung.

2. The paint pail holder as claimed in claim 1, wherein the edges of the inverted V-shaped elongated sheet metal support bar adjacent the bifurcation are serrated to improve the frictional engagement along both edges of the inverted V-shaped metal bar and said open end of said hollow rung.

3. The paint pail holder as claimed in claim 1, further comprising a vertically adjustable screw threaded to the top of the elongated sheet metal support bar at its apex adjacent the end of the bar opposite said bifurcation to control the inclination of the sheet metal support bar within said hollow rung to adjust the bar to hollow rungs of varying internal diameter.

4. The paint pail holder as claimed in claim 2, further comprising a vertically adjustable screw threaded to the top of the elongated sheet metal support bar at its apex adjacent the end of the bar opposite said bifurcation to control the inclination of the sheet metal support bar to adjust the bar to hollow rungs of varying internal diameter.

5. The paint pail holder as claimed in claim 1, further comprising a generally inverted L-shaped wire rod fixedly mounted to the elongated sheet metal support bar at said bifurcations and projecting vertically upwardly therefrom terminating in a bent portion at some angle thereto such that the bent portion permits the handle of a brush inserted into the open paint pail to hang thereon via a hole in the end of said handle.

6. A wooden ladder adaptor for supporting a paint pail holder which, in turn, supports an open paint pail having an internally flanged rim to the side of a wooden ladder, said ladder having a plurality of spaced solid rungs extending between elongated parallel side rails, and wherein said paint pail holder comprises an elongated sheet metal support bar of inverted V-shaped cross-section with said bar being bifurcated at one end forming outwardly flared wings, and wherein a downwardly facing hook integral with the support bar and extending outwardly thereof between the wings is engageable with the rim of the paint pail with said wings contacting the outside of the pail below said rim, so that the paint pail is securely grasped and held in upwardly open position, said wooden ladder adaptor comprising:

a unitary channel shaped planar sheet member of U-shaped configuration including a base and laterally opposed parallel sides, reverse L-shaped slots within said sides forming opposed, laterally spaced upper hook-shaped arms and lower arms spaced therefrom, said lower arms being of a length so as to project beyond a rear edge ladder rail when the wooden ladder adaptor is placed with its base in contact with the front edge of one ladder rail with said wooden rung of said ladder being received within said reverse L-shaped slot within the side of said adaptor to the inside of said rail, said lower arms being of a length so as to project beyond the ladder rail, aligned holes within the lower arms sized to receive said elongated sheet metal support bar, such that the apex of said sheet metal support bar contacts the upper edge of one of said hole within the lower arm on the inside of the wooden ladder rail, and wherein the lower edges of said inverted V-shaped cross-section elongated sheet metal support bar engage the bottom of said other of said aligned holes within said lower arm to the outside of said ladder side rail, so as to effectively frictionally lock said elongated sheet metal support bar to said adaptor with said paint pail securely fixed to said sheet metal elongated support bar outside of said bifurcated wings under the weight of the pail and its contents.

7. In combination, a paint pail holder assembly and a wooden ladder adaptor for supporting an open paint pail having an internally flanged rim, to the side of a wooden ladder having a plurality of solid rungs, said assembly comprising:

an elongated sheet metal support bar of inverted V-shaped cross-section, said bar being bifurcated at one end forming outwardly flared wings, a downwardly facing hook integral with said bar at said bifurcation and positioned between said wings, said hook engageable with the paint pail rim with said wings contacting the outside of the pail below said rim to securely frictionally grasp the pail and to hold it in upright open position, said wooden ladder adaptor comprising a planar sheet member of U-shaped configuration including a base and laterally opposed sides extending at right angles thereto to said base, in the same direction, reverse L-shaped slots formed within said sides and separating each side into an upper hook-shaped arm and a lower arm, said lower arms being of a length so as to project beyond the rear of the ladder rail when the base of said adaptor contacts the front edge of said ladder rail with said sides of said U-shaped adaptor extending along opposite sides of said ladder rail, aligned holes within the ends of said lower arms having a diameter slightly in excess of the largest cross-sectional dimension of said elongated sheet metal support bar and receiving the non-bifurcated end of said bar such that the apex of said elongated sheet metal bar engages the upper edge of one of said aligned holes within the lower arm on the inside of said latter rail and the bottom edges of said inverted V-shaped cross-section elongated sheet metal bar engages the bottom of said other of said aligned holes in said lower arm to the outside of said latter rail, such that said elongated sheet metal support bar inclines slightly downwardly and outwardly from said ladder with the weight of said paint pail and its contents causing a frictional locking effect between said elongated sheet metal support bar and said wooden ladder adaptor, while maintaining the adaptor engaged with the solid wooden rung of said ladder and with the pail effectively positioned in free upwardly open position to the side of said ladder rail carrying said wooden ladder adaptor.

8. The paint pail holder as claimed in claim 5, wherein said generally inverted L-shaped wire rod comprises a wire rod member bent intermediate of its ends to form parallel legs, and wherein the inverted V-shaped cross-section metal bar includes paired vertical slots where the bifurcated wings join the bar proper, and wherein said parallel legs project within said slots for frictional engagement therewith such that the inverted L-shaped wire rod member may be raised and lowered to vary the vertical height of the bent portion thereof which projects through the hole in the end of the paint brush handle.

9. The paint pail holder as claimed in claim 8, wherein said wire rod legs from the initial bend defining said legs over a short distance thereof are bent into contact with each other to define a paint brush handle supoprting portion sized so as to pass readily through a smaller diameter hole within the paint brush impaled thereon.

* * * * *